US005225799A

United States Patent [19]

West et al.

[11] Patent Number: 5,225,799

[45] Date of Patent: Jul. 6, 1993

[54] MICROWAVE FILTER FABRICATION METHOD AND FILTERS THEREFROM

[75] Inventors: Laurice J. West, Ventura; Joel J. Raymond, Port Hueneme, both of Calif.

[73] Assignee: California Amplifier, Camarillo, Calif.

[21] Appl. No.: 977,306

[22] Filed: Nov. 16, 1992

Related U.S. Application Data

[63] Continuation of Ser. No. 710,092, Jun. 4, 1991, abandoned.

[51] Int. Cl.[5] ..... H01P 1/20

[52] U.S. Cl. ..... 333/202; 333/185

[58] Field of Search ..... 333/202, 204, 205, 206, 333/207, 222, 227, 202 DB, 219, 223, 245, 246, 185; 361/392, 399

[56] References Cited

U.S. PATENT DOCUMENTS 4,829,274 5/1989 Green et al. ..... 333/202

5,079,528 1/1992 Yorita et al. ..... 333/206

*Primary Examiner*—Robert J. Pascal

*Assistant Examiner*—Ali Neyzari

*Attorney, Agent, or Firm*—Freilich, Hornbaker & Rosen

[57] ABSTRACT

A microwave filter (30) and method of fabrication in which an integral housing (22) defining a cavity (23) is formed from a blank (20) cut from a conductive sheet. The blank is bent to form the housing. The resultant housing includes resonators, resonator taps, tuning holes and tap apertures. Capacitance tabs and coupling tabs are added to the housing for tuning of the filter. The tabs are adjusted by access through the tuning holes in the blank. The blank further defines stops which align the taps with lines of a microstrip circuit when the filter is installed therein and grounding tabs for grounding to the microstrip ground plane. The filter may be in combline or interdigital configuration.

15 Claims, 7 Drawing Sheets

MICROWAVE FILTER FABRICATION METHOD AND FILTERS THEREFROM

This is a continuation of co-pending application Ser. No. 07/710,092 filed on Jun. 4, 1991 now abandoned.

FIELD OF THE INVENTION

The present invention pertains to microwave filters and more particularly, to economical fabrication methods therefor and filters resulting therefrom.

BACKGROUND OF THE INVENTION

Cavity microwave filter design is a well established art and practical designs exist, in particular, for combline and interdigital filters. Such filters, however, often are fabricated of several separately fabricated elements (e.g. cavity walls, resonators, frequency and coupling trimming devices and end resonator taps) which then have to be assembled to exacting tolerances to achieve the desired filter transmission parameters. Such fabrication and assembly is costly in terms of labor man hours. Efforts, therefore, have been made to reduce the fabrication cost. For example, U.S. Pat. No. 4,791,717 discloses a construction method, for an interdigital filter integrated into a down converter, which attempts to reduce the number of separate parts to be assembled by bending a specially cut piece of sheet metal to form part of a cavity housing.

Other U.S. Patents of interest are U.S. Pat. Nos. 2,530,691, 3,737,816, 3,925,883, 4,647,882, 4,802,234, 4,837,535, 4,849,724, 4,963,844 and 4,970,480.

SUMMARY OF THE INVENTION

The present invention is directed to microwave filters formed by a specially cut blank of conductive sheet material.

In a preferred embodiment the blank is cut to define wall portions, demarked by bend lines, which can be bent to form a housing defining a substantially closed cavity.

In accordance with a significant feature of a preferred embodiment, extensions, functionally useful as resonator or tuning elements, are formed integral with the blank for projecting into the cavity when the housing is formed.

In accordance with another significant feature, extensions, functionally useful as cavity coupling elements, are formed integral with the blank for external connection to a microstrip circuit.

In accordance with a still further feature, positioning stops are formed integral with the blank to facilitate aligned mounting of the housing on a microstrip circuit board.

In accordance with yet another feature, grounding tabs are formed integral with the blank to facilitate connecting the housing with a microstrip circuit ground plane.

The novel features of the invention are set forth with particularity in the appended claims. The invention will be best understood from the following description when read in conjunction with the accompanying drawings.

DETAILED DESCRIPTION

The present invention is directed to a method for economically fabricating microwave filters and to the filters produced as a result thereof.

Figure 1A:
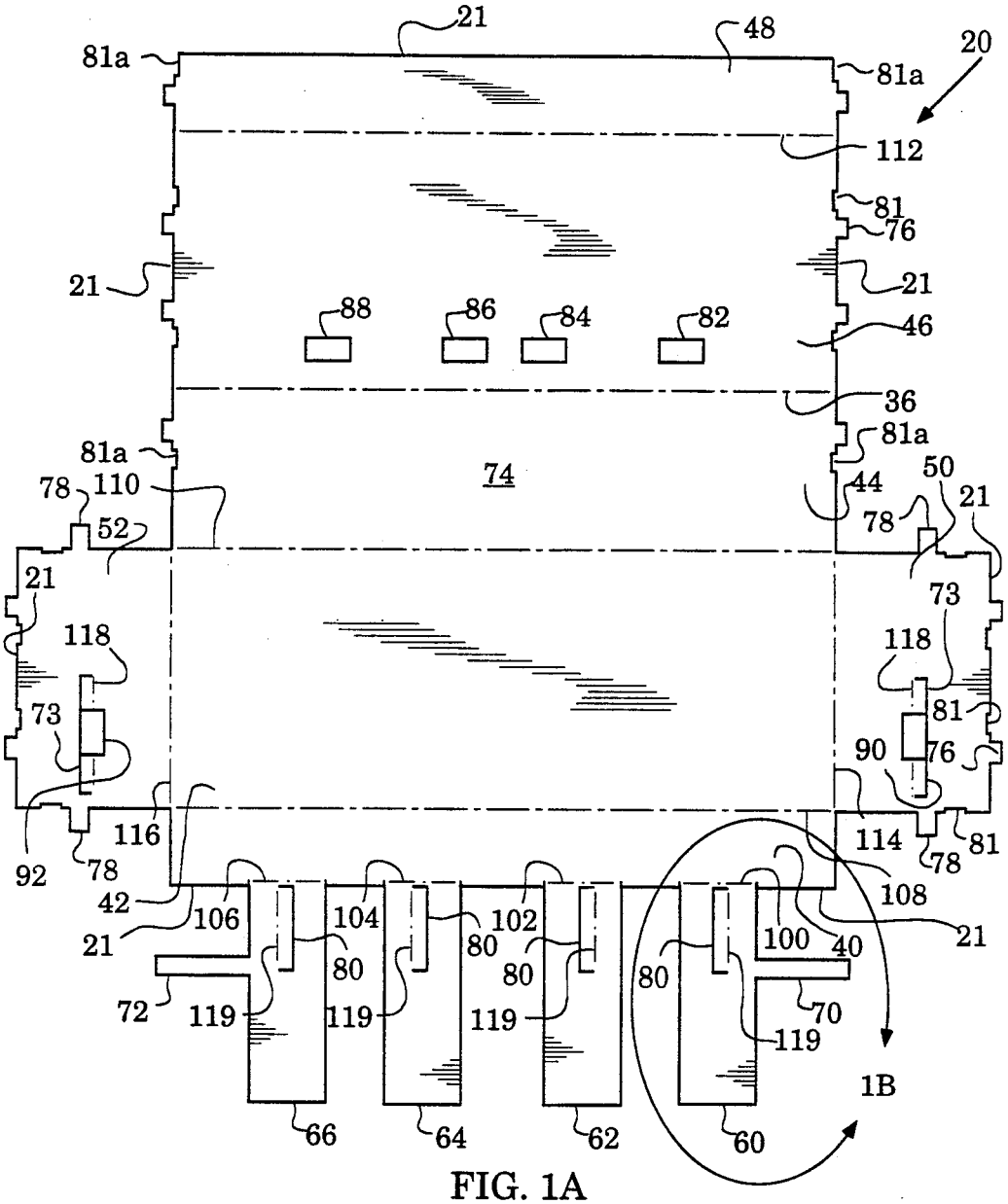
FIG. 1A is a plan view of a conductive blank embodiment suitable for forming into a microwave filter housing in accordance with the present invention.
Figure 2:
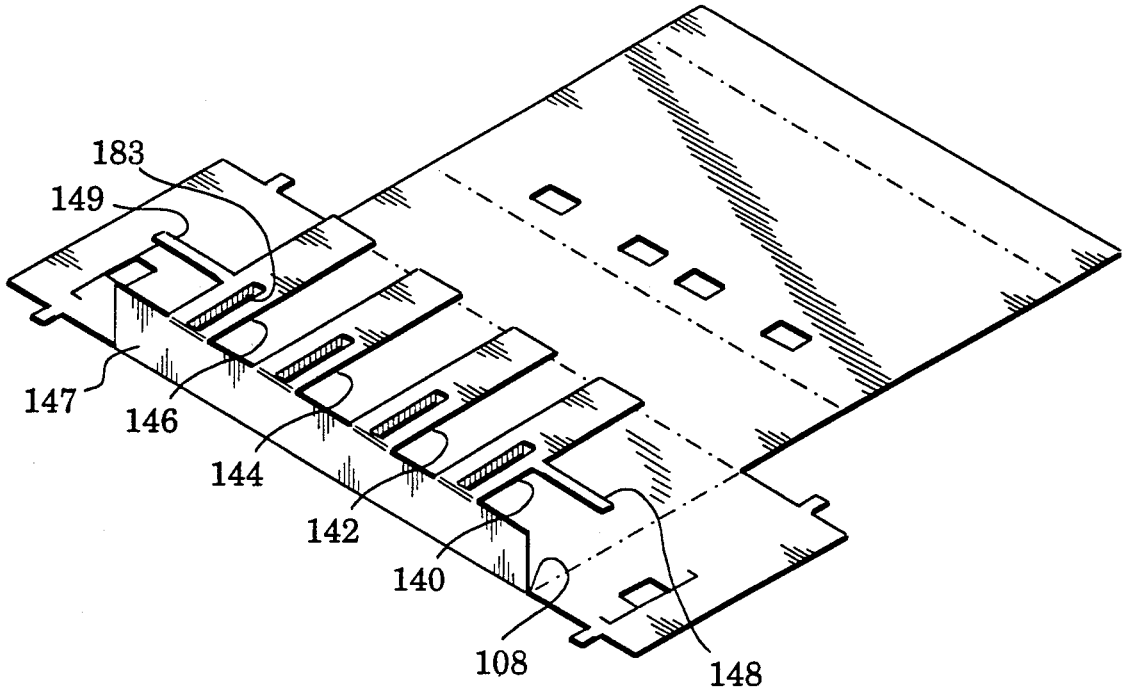
FIG. 2 is an isometric view illustrating a transitional phase in the formation of a microwave combline filter from the blank of FIG. 1.
Figure 3:
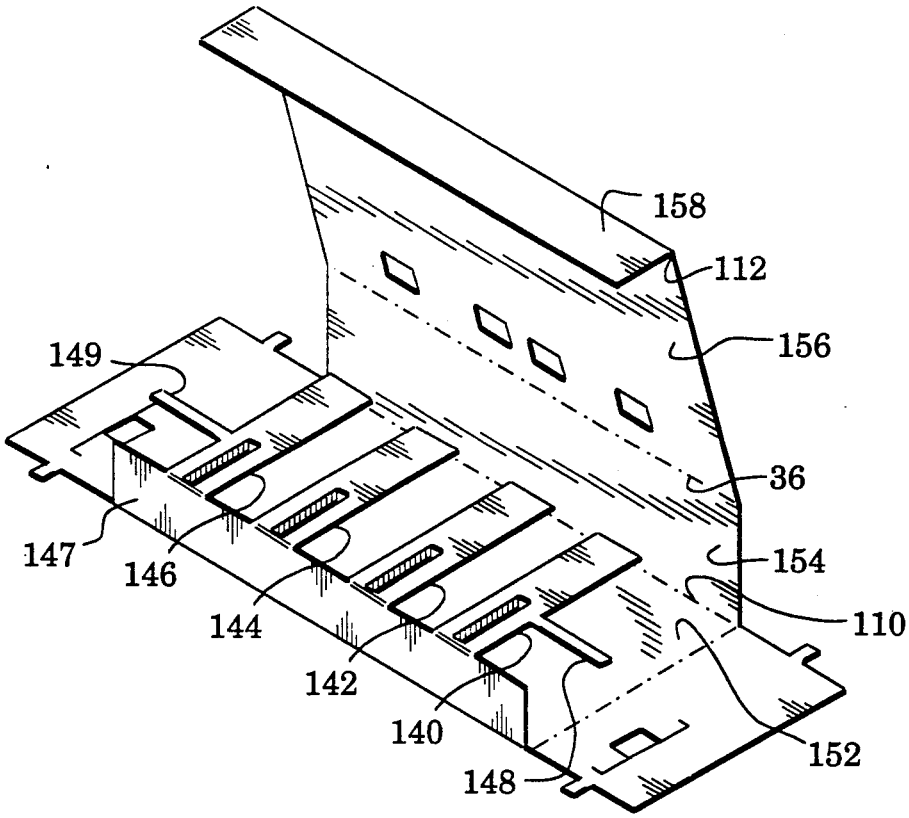
FIG. 3 is an isometric view illustrating a transitional phase in the formation of a microwave combline filter from the blank of FIG. 1.
Figure 4:
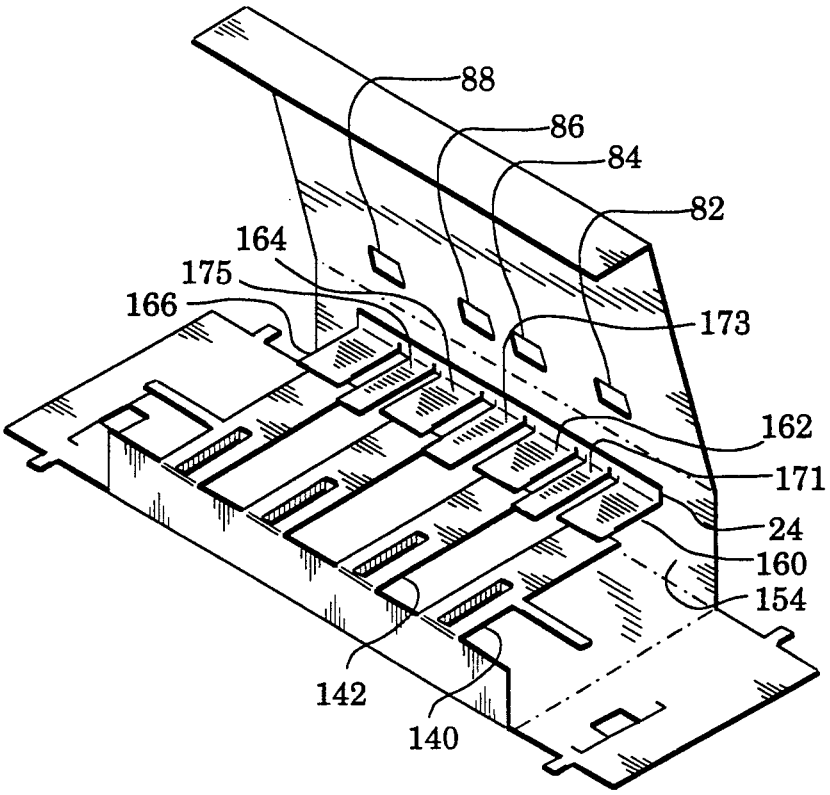
FIG. 4 is an isometric view illustrating a transitional phase using capacitance and coupling tabs in the formation of a microwave combline filter from the blank of FIG. 1.
Figure 5:
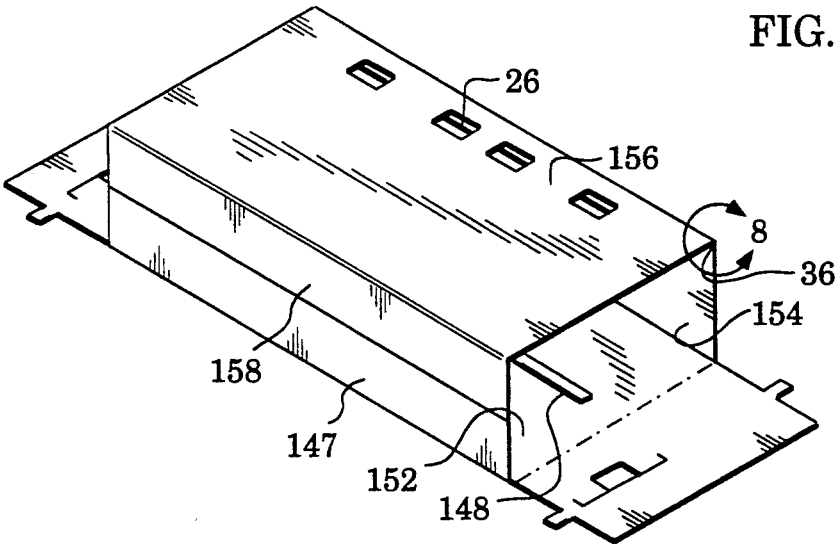
FIG. 5 is an isometric view illustrating a transitional phase in the formation of a microwave combline filter from the blank of FIG. 1.
Figure 6:
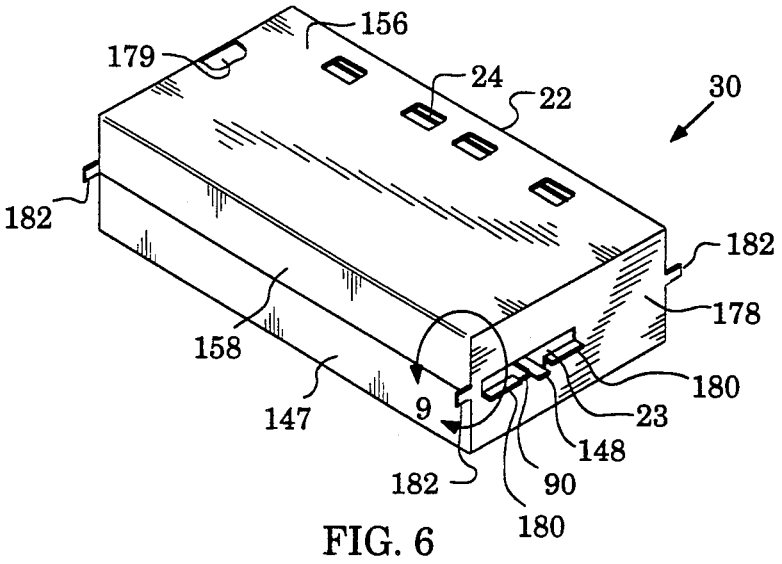
FIG. 6 is an isometric view of a microwave combline filter embodiment formed from the blank of FIG. 1 in accordance with the present invention.
Figure 7:
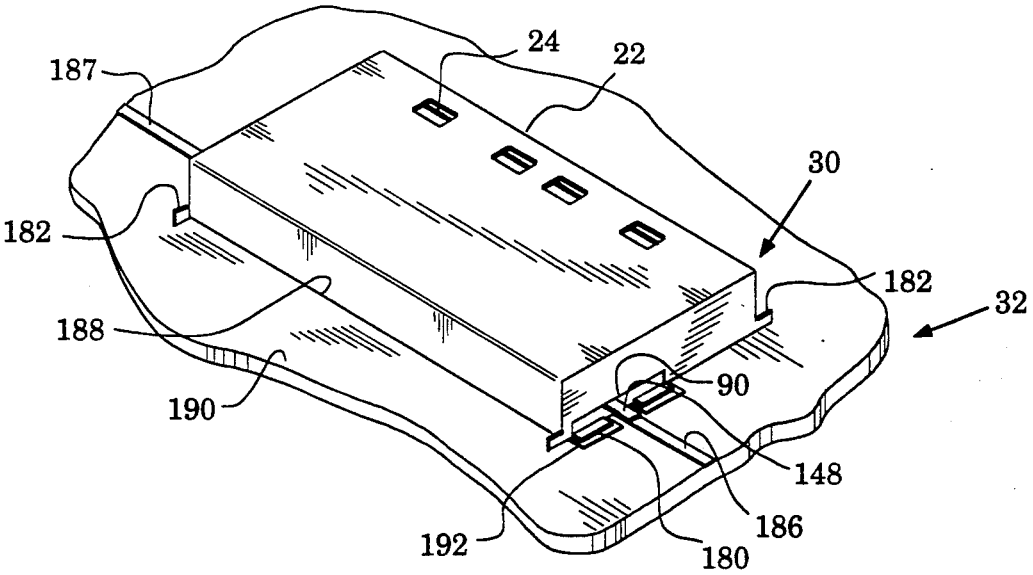
FIG. 7 is an isometric view illustrating the microwave combline filter of FIG. 6 installed in a microstrip circuit.

In accordance with the invention, a blank 20, fabricated from a sheet of conductive material (e.g. copper, brass or aluminum; brass or aluminum may be silver plated to facilitate soldering and improve conductivity), as illustrated in FIG. 1A, is formed as shown in the transitional steps of FIGS. 2 through 5 into the housing 22 of FIG. 6 defining a cavity 23 therein. The housing 22 and the tuning bracket 24 mounted therein, as shown in FIG. 4, form the the microwave combline filter 30 of FIG. 6 which is suitable for mounting in a microstrip circuit 32 as shown in FIG. 7.

After the blank 20 is bent as shown in the aforementioned figures and the tuning bracket 24 mounted therein, the adjoining edges of the formed blank are bonded in a manner well known in the art (e.g. soldering or welding) to complete fabrication of the filter 30.

Thus the fabrication is simple and economical requiring only manipulative steps similar to the art of paper folding known as origami. Consequently, fabrication labor hours are reduced compared to conventional techniques. The blank 20 may be fabricated by standard methods (e.g. stamping, etching, cutting, or laser milling) in sufficient numbers for a production run and economically stored until needed for assembly. The fabrication method used for the blank may also be used to simultaneously create bend lines such as bend line 36 in FIG. 1A by weakening the material therealong (e.g. partial removal of material or intermittent holes or slots). Forming of the blank 20 into the housing 22 is then reduced to simple bending along the bend lines.

In particular, FIG. 1A is a plan view of a blank 20 fabricated from a sheet of electrically conductive material. The blank 20 defines portions which correspond, respectively, to housing elements and structural elements in the housing 22. The housing elements are housing walls, housing ends, resonators, resonator taps and grounding tabs. The structural elements are fingers, stops and resonator stiffening flaps.

The blank 20 defines a peripheral edge 21 extending around a plurality of planar housing portions including wall portions 40, 42, 44, 46 and 48 and end portions 50 and 52. The planar portions, including leading and trailing wall portions 40 and 48, respectively, and intermediate wall portions 42, 44 and 46 are connected in series, separated by boundaries in the form of bend lines 36, 108, 110 and 112. Other intermediate wall portions 50 and 52 are contiguous with planar portion 42 at opposite ends thereof and respectively separated therefrom by bend lines 114, 116.

As will be explained in detail hereinafter, when the blank 20 is folded about its bend lines to form the housing 22 (as shown in FIG. 6), portions 42 and 46 respectively form bottom and top walls, portion 44 forms a rear wall, portions 40 and 48 respectively form front upper and lower walls, and portions 50 and 52 form left and right end walls. With the blank folded so as to form housing 22, each part of the peripheral edge 21 lies adjacent to another part of the peripheral edge. These adjacent edge parts are preferably sealed by a suitable procedure, e.g., soldering, so that the planar housing portions define a substantially closed internal cavity 23 (as shown in FIG. 6).

With continuing reference to FIG. 1A, note that extensions in the form of planar resonator portions 60, 62, 64 and 66 are formed integrally with the blank 20, extending outwardly from the peripheral edge 21, contiguous with planar portion 40 and respectively separated therefrom by boundaries in the form of bend lines 100, 102, 104 and 106. Note that the height of rear wall portion 44 equals the sum of the heights of front upper and lower wall portions 40, 48.

Thus, with the blank 20 bent around the bend lines to form the housing 22 of FIG. 6, the extensions 60, 62, 64, and 66, bent perpendicular to the front lower wall portions 40, will project into the cavity 23 to be spaced from both the bottom and top wall portions 42, 46 and the rear wall portion 44. Although the height of front upper and lower wall portions 40, 48 are shown in FIGS. 1–6 to be substantially equal, it should be understood that the teachings of the invention include unequal heights which would cause the spacing between the extensions and bottom and top wall portions 42, 46 to also be unequal.

Therefore, the wall portions, end portions and extensions of the blank 20 in FIG. 1A correspond to the housing walls, ends and resonators of the housing 22 of FIG. 6. In a similar manner, the tap portions 70, 72 and grounding tab portions 73 of the blank 20 correspond to the taps and grounding tabs of the housing 22. The tap portions 70, 72 extend from, and are contiguous with, respectively, resonator portions 60, 66. The grounding tab portions 73 are defined by each of the end portions 50, 52. The wall portions 40, 42, 44, 46, 48, 50 and 52 taken together, form a body portion 74.

Similarly, the blank 20 has finger portions 76, stop portions 78 and flap portions 80 corresponding to the structural fingers, stops and flaps on the cavity 22. The blank 20 also defines notches 81, tuning holes 82, 84, 86 and 88 and apertures 90, 92. Bend lines 36, 100, 102, 104, 106, 108, 110, 112, 114, 116, 118 and 119 are defined in a manner similar to that described above relative to bend line 36. For clarity of illustration only exemplary finger portions 76 and notches 81 are designated on FIG. 1. Four notches **81*a* have a function which differs from that of the notches 81. The function of both will be described in conjunction with FIG. 9**.

Figure 1B:
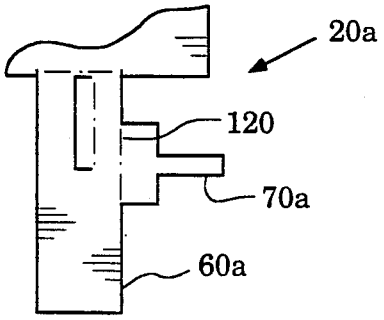
FIG. 1B is a view of the area within the line 1B of FIG. 1A illustrating another blank embodiment in accordance with the present invention.

FIG. 1B illustrates another embodiment of the terminal resonator portions 60, 66 of blank 20. FIG. 1B is a view similar to the area within the line 1B of FIG. 1A showing a capacitance tap portion **70*a* contiguous with a resonator portion 60*a* in a blank 20*a*. The blank 20*a* is otherwise similar to the blank 20. Partition line 120 is defined in a manner similar to that described above relative to bend line 36. The purpose of partition line 120** will be described below.

Figure 1C:
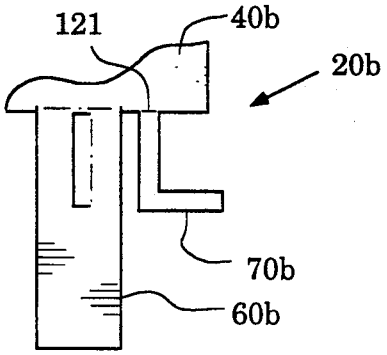
FIG. 1C is a view similar to FIG. 1B illustrating another blank embodiment in accordance with the present invention.

FIG. 1C illustrates another embodiment of the terminal resonator portions 60, 66 of blank 20. FIG. 1C is a view similar to FIG. 1B showing a coupling loop portion **70*b* contiguous with a wall portion 40*b* and adjacent a resonator portions 60*b* in a blank 20*b*. The coupling loop portion has a bend line 121. The blank 20*b* is otherwise similar to the blank 20. The bend line 121 is defined in a manner similar to that described above relative to bend line 36**.

The purpose of those portions of the blank 20 corresponding to housing elements will now be described followed by a description of those portions corresponding to structural elements.

In FIG. 2 the resonator portions 60, 62, 64 and 66 have been bent along bend lines 100, 102, 104 and 106 to form resonator elements 140, 142, 144 and 146 while wall portion 40 has been bent along bend line 108 to form a partial housing wall 147. Resonator tap portions 70, 72 have become, respectively, resonator taps 148, 149.

In FIG. 3 wall portion 44 has been bent along bend line 110 to form housing walls 152 and 154, wall portion 46 has been partially bent along bend line 36 to form housing wall 156 and wall portion 48 has been bent along bend line 112 to form partial wall 158. Partial walls 147 and 158, when joined, will form the housing wall opposite housing wall 154.

In FIG. 4 the tuning bracket 24 has been bonded (e.g. soldered or welded) to the housing wall 154. The tuning bracket 24 has capacitance tabs 160, 162, 164, 166 and coupling tabs 171, 173, 175. Each capacitance tab is spaced above a corresponding resonator (e.g. capacitance tab 160 and resonator 140) and each coupling tab is spaced above and substantially equidistant from a corresponding pair of resonators (e.g. coupling tab 171 and resonators 140, 142).

Capacitance tabs are used to adjust the capacitance of the resonators while coupling tabs are used to adjust the electromagnetic coupling between resonators by bending them in manners well known in the art. Access to each of the capacitance tabs and coupling tabs is gained through a corresponding one of the tuning holes 82, 84, 86 and 88 (e.g. access to capacitance tab 160 and coupling tab 171 is through tuning hole 82). These tuning elements (capacitance tabs and coupling tabs) facilitate adjustment of resonator capacitance and coupling between resonators to tune the transfer function of the filter (30 in FIG. 7).

In FIG. 5 the bend along bend line 36 has been completed so that partial housing walls 147 and 158 adjoin. In FIG. 6, end portions 50 and 52 have been bent along bend lines 114 and 116 to form, respectively, housing ends 178, 179 (wall 156 is broken away to show end 179). Resonator tap 148 now extends through aperture 90 (similarly, but not shown, resonator tap 149 extends through aperture 92). Grounding tab portions 73 are bent along bend lines (118 in FIG. 1A) to form grounding tabs 180. All adjoining housing wall and end edges are bonded to complete the fabrication of the housing 22 defining the cavity 23 therein. Thus the filter 30, illustrated in FIG. 6, is comprised of only two elements, the housing 22 and the tuning bracket 24.

Figure 9:
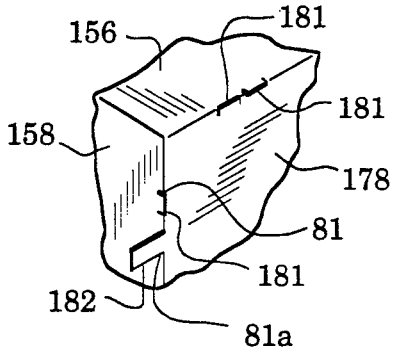
FIG. 9 is an enlarged view of the area within the line 9 of FIG. 6.

In the transitional steps illustrated in FIGS. 2 through 5 the finger portions 76 become structural fingers 181 which are received in corresponding notches 81 as shown in FIG. 9 which is an enlarged view of the area enclosed by the line 9 in FIG. 6. Each interlocked finger and corresponding notch, when bonded, adds ease of alignment and structural strength to the housing 22. The stop portions 78 of the blank 20 become stops 182 as shown in FIG. 9. The stops 182 fit into the notches **81*a* of the blank 20. The purpose of the stops 182 will be described below. The flap portions 80 of the blank 20 are bent relative to the resonators 140, 142, 144 and 146 along bend lines 119 as shown in FIG. 2 (designated on resonator 146) to become flaps 183 which add structural strength thereto. The end of each flap 183 nearest the partial wall 147** abuts therewith and the line of abutment is soldered for additional strength.

In FIG. 7 the filter 30 is connected to a microstrip circuit 32. The stops 182 automatically align the resonator tap 148 along the microstrip line 186 when the filter 22 is dropped into a corresponding hole 188 in the circuit board 190 (similarly, but not shown, resonator tap 149 is aligned along microstrip line 187). The grounding tabs 180 are bonded to ground pads 192 of the microstrip circuit board 190. The ground pads 192 are electrically connected to the microstrip ground plane (far side of board 190) by suitable means (e.g. plated through holes). The resonator taps 148, 149 are bonded, respectively, to microstrip lines 186, 187 in manners well known in the art.

Figure 8:
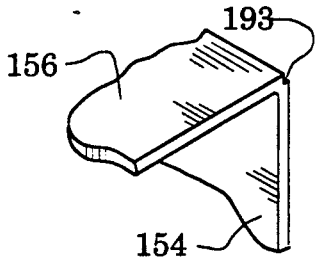
FIG. 8 is an enlarged view of the area within the line 8 of FIG. 5.

FIG. 8, which is an enlarged view of the area enclosed by the line 8 of FIG. 5, illustrates that the blank 20 is bent away from areas 193 of removed material (described relative to bend line 36 above) that define the bend lines of FIG. 1A. Thus the inner housing surface has a smooth transition between walls which prevents creation of electromagnetic discontinuities.

Figure 10:
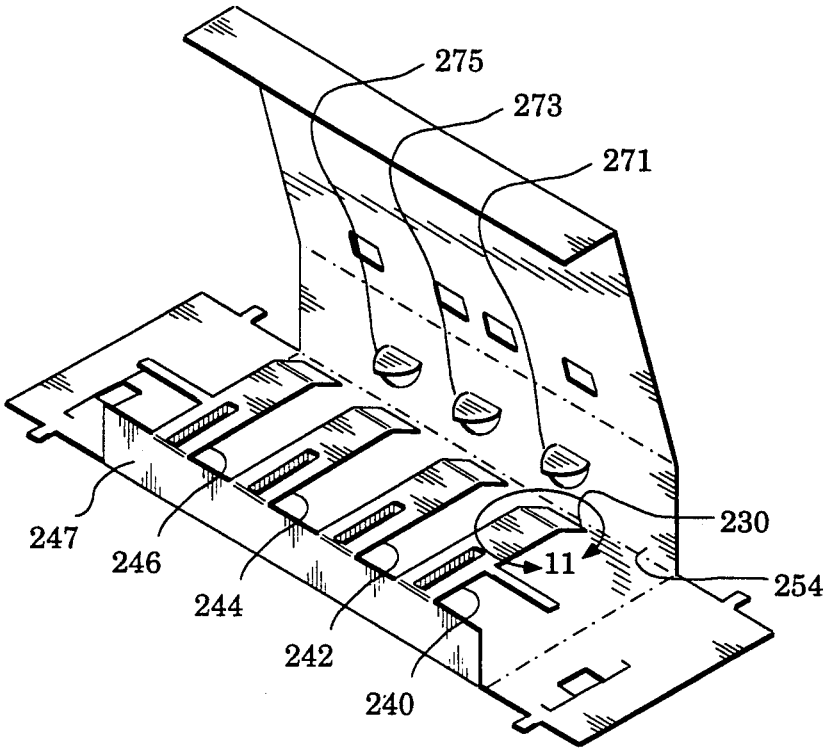
FIG. 10 is an isometric view of another microwave combline filter embodiment in accordance with the present invention.
Figure 11:
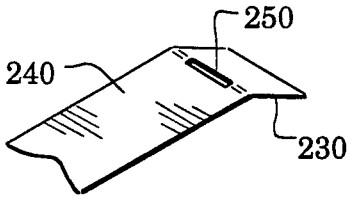
FIG. 11 is an enlarged view of the area within the line 11 of FIG. 10.

FIG. 10 is a isometric view illustrating another embodiment of the capacitance and coupling adjustments shown in FIG. 4. Capacitance tips 230 terminate resonators 240, 242, 244, 246 and are bent relative thereto to adjust the capacitance thereof similar to the functioning of the capacitance tabs 160, 162, 164 and 166 of FIG. 4. The resonators extend from a wall 247. FIG. 11 is an enlarged view of the area enclosed by the line 11 of FIG. 10 and shows a slot 250 that facilitates bending of the capacitance tips 230. The slots 250 would be defined in a blank similar to the blank 20 of FIG. 1A.

The housing wall 254 has coupling ears 271, 273 and 275 which may be used to adjust resonator coupling similar to tabs 171, 173 and 175 shown in FIG. 4. The ears 271, 273 and 275 would also be defined in a blank similar to the blank 20 of FIG. 1A.

Figure 12:
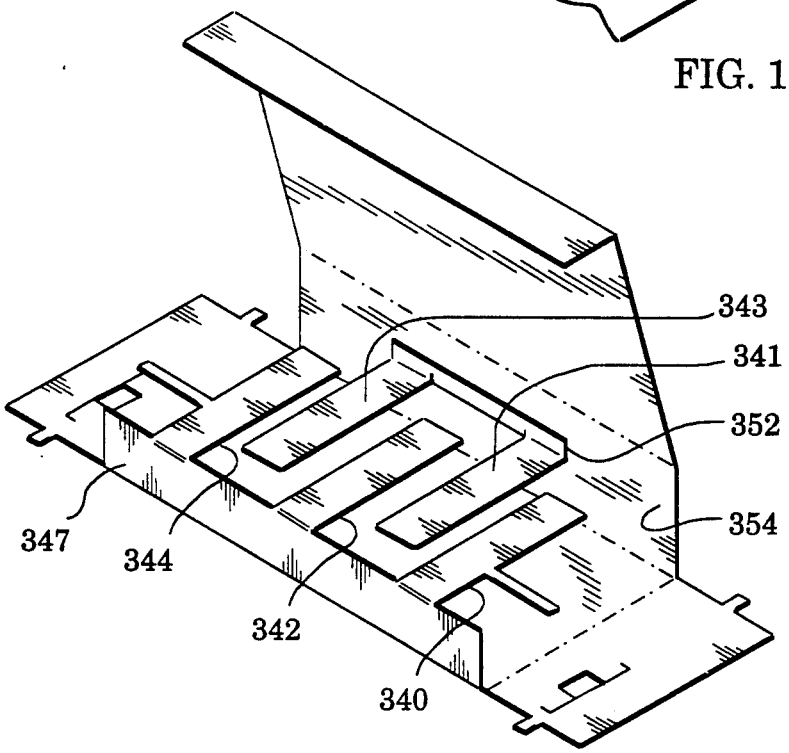
FIG. 12 is an isometric view of a microwave interdigital filter embodiment in accordance with the present invention.

FIG. 12 is an isometric view similar to FIG. 4 illustrating another embodiment in which resonators 341 and 343 are interdigitated with resonators 340, 342 and 344 extending from the partial housing wall 347. The resonators 341 and 343 are defined on a resonator bracket 352 which mounts on housing wall 354.

Figure 13:
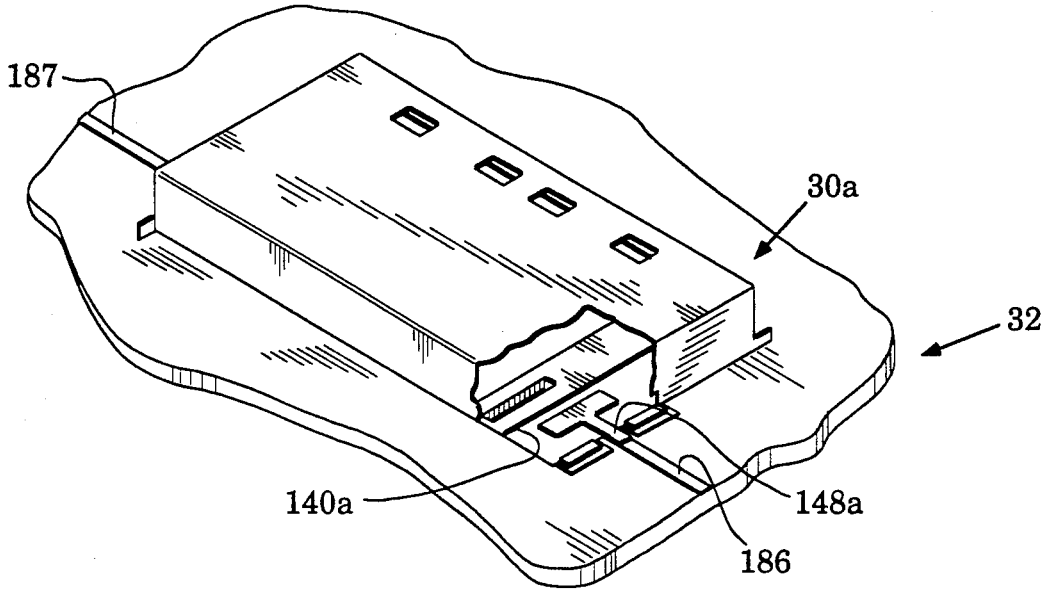
FIG. 13 is a view similar to FIG. 7 illustrating another filter embodiment in accordance with the present invention installed in a microstrip circuit.

FIG. 13 is a view similar to FIG. 7 illustrating another filter embodiment installed in the microstrip circuit 32. The filter **30*a* has a capacitance tap 148*a* soldered to the microstrip line 186 in capacitive coupling association with the resonator 140*a*. The capacitance tap 148*a* and resonator 140*a* are formed from, respectively, the capacitance tap portion 70*a* and resonator portion 60*a* illustrated in FIG. 1B by breaking the capacitance tap portion 70*a* away from the resonator portion 60*a* along the partition line 120. A similar cavity coupling arrangement can be used to couple to the microstrip line 187**.

Figure 14:
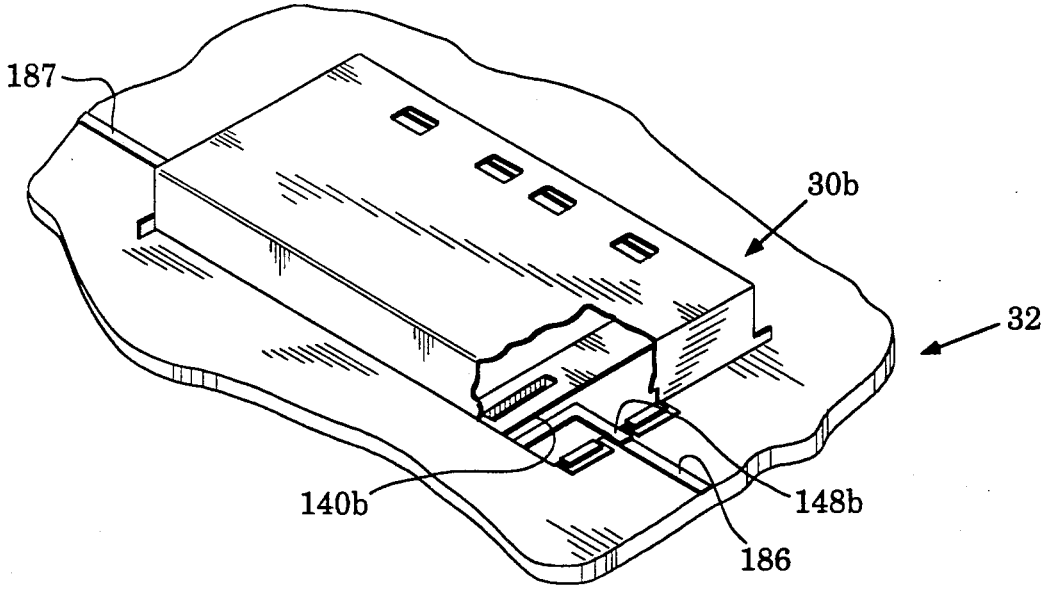
FIG. 14 is a view similar to FIG. 7 illustrating another filter embodiment in accordance with the present invention installed in a microstrip circuit.

FIG. 14 is a view similar to FIG. 7 illustrating another filter embodiment installed in the microstrip circuit 32. The filter **30*b* has an inductance loop 148*b* soldered to the microstrip line 186 in inductive coupling association with the resonator 140*b*. The inductive loop 148*b* and resonator 140*b* are formed from, respectively, the inductive loop portion 70*b* and resonator portion 60*b* illustrated in FIG. 1C. The inductive loop portion 70*b* is bent along the bend line 121 (shown in FIG. 1C) to form the inductive loop 148*b*. A similar cavity coupling arrangement can be used to couple to the microstrip line 187**.

Figure 15:
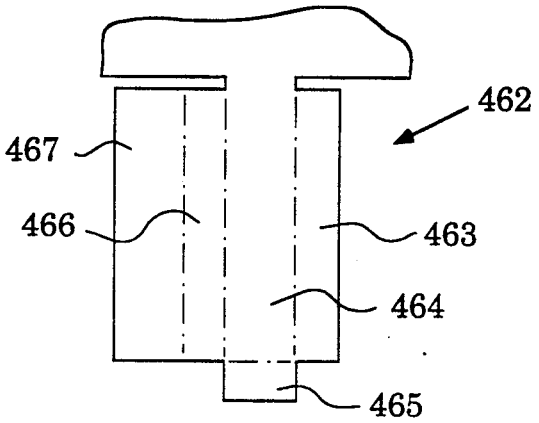
FIG. 15 is a plan view of another embodiment of a resonator portion of the blank of FIG. 1.
Figure 16:
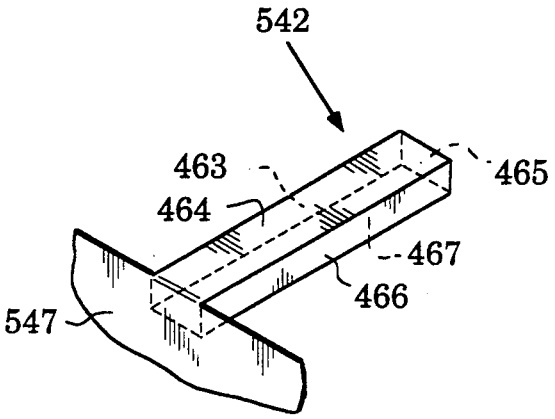
FIG. 16 is an isometric view of another resonator embodiment formed of the resonator portion of FIG. 15.

FIG. 15 is a plan view of another embodiment of a resonator portion 462 similar to the resonator portion 62 of FIG. 1A. The resonator portion 462 has sub-portions 463, 464, 465, 466 and 467. The resonator portion 462 is formed and bonded into the resonator embodiment 542 (similar to resonator 142) shown in FIG. 16 in which the location of the sub-portions is indicated. The resonator 542 may be bonded at its base to the housing wall 547.

Figure 17:
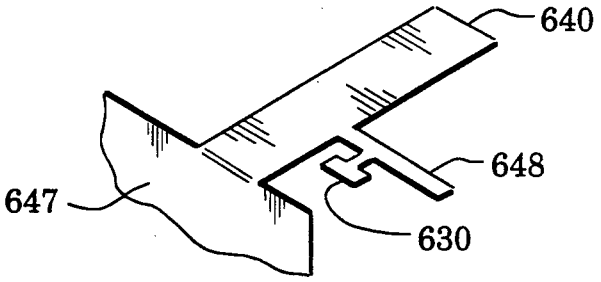
FIG. 17 is an isometric view of another embodiment of a tap portion of the blank of FIG. 1.

An impedance matching tab 630 extending from a tab embodiment 648 on a resonator 640 and a housing wall 647 is illustrated in the isometric view of FIG. 17. The tab 630 would be used to match the line impedance of a stripline circuit in which the resonator 640 would be integrated. The tab 630 would be defined in a blank similar to the blank 20 of FIG. 1A.

From the foregoing it should now be recognized that a fabrication method has been disclosed herein utilizing a blank fabricated from a conductive sheet and configured to be formed and bonded into a microwave filter housing. Apparatus in accordance with the present invention can be assembled easily and are thus economical to produce.

It should also be recognized that, although resonators 60, 62, 64 and 66 and taps 70, 72 were defined in the blank 20 of FIG. 1 and capacitance tabs 160, 162, 164 and 166 and coupling tabs 171, 173 and 175 were attached to a housing wall 154 in FIG. 4, the element locations could be interchanged. Thus, in general, extensions (whether resonators, taps, capacitance tabs or coupling tabs) could be formed integral with the blank 20 and folded to extend into a cavity formed therewith.

Although the present invention has been described with reference to preferred embodiments, numerous modifications and rearrangements can be made with the equivalent result still embraced within the scope of the invention.

What is claimed is:

1. A microwave filter, including:

a housing formed by an integral blank of conductive sheet material bent to define a substantially closed cavity; and one or more extensions formed by said integral blank projecting into said cavity;

wherein each of said extensions includes a tuning element and said tuning element comprises a bendable coupling tab.

2. A microwave filter, including:

a housing formed by an integral blank of conductive sheet material bent to define a substantially closed cavity;

one or more extensions formed by said integral blank projecting into said cavity wherein each of said extensions comprises a resonator; and variable resonator coupling means within said housing for adjusting the electromagnetic coupling of said resonators wherein said resonator coupling means comprises a tuning bracket mounted to said housing, said tuning bracket defining a plurality of bendable coupling tabs, each of said coupling tabs arranged substantially equidistant a different pair of said resonators for adjusting the electromagnetic coupling therebetween.

3. A microwave filter, including:

a housing formed by an integral blank of conductive sheet material bent to define a substantially closed cavity;

one or more extensions formed by said integral blank projecting into said cavity wherein each of said extensions comprises a resonator; and variable resonator coupling means within said housing for adjusting the electromagnetic coupling of said resonators wherein said resonator coupling means comprises a plurality of bendable coupling ears formed by said integral blank bent to extend into said cavity, each of said coupling ears arranged substantially equidistant a different pair of said resonators for adjusting the electromagnetic coupling therebetween.

4. A microwave filter, including:

a housing formed by an integral blank of conductive sheet material bent to define a substantially closed cavity;

one or more extensions formed by said integral blank projecting into said cavity wherein each of said extensions comprises a resonator; said integral blank defining, in said housing, one or more apertures; cavity coupling means formed by said integral blank extending through one of said apertures for coupling an external circuit to said cavity; and a plurality of stops defined on said housing by said integral blank for aligning each of said cavity coupling means with a corresponding line of a microstrip circuit receiving said filter.

5. A microwave filter, including:

a housing formed by an integral blank of conductive sheet material bent to define a substantially closed cavity;

one or more extensions formed by said integral blank projecting into said cavity wherein each of said extensions comprises a resonator; said integral blank defining, in said housing, one or more apertures; and cavity coupling means formed by said integral blank extending through one of said apertures for coupling an external circuit to said cavity wherein said cavity coupling means comprises a capacitance tap, defined by said integral blank, detached from one of said resonators and spaced therefrom on a circuit line associated with said filter.

6. A microwave filter, including:

a housing formed by an integral blank of conductive sheet material bent to define a substantially closed cavity;

one or more extensions formed by said integral blank projecting into said cavity wherein each of said extensions comprises a resonator; said integral blank defining, in said housing, one or more apertures; and cavity coupling means formed by said integral blank extending through one of said apertures for coupling an external circuit to said cavity wherein said cavity coupling means comprises an inductive loop, defined by said integral blank, bent substantially parallel to one of said resonators.

7. A microwave filter, comprising:

an integral blank of conductive sheet material defining a peripheral edge extending around a plurality of planar portions separated by boundary lines and including a leading planar portion, a trailing planar portion and one or more intermediate planar portions;

said blank including one or more extensions integrally formed therewith, said extensions extending outward from said peripheral edge and contiguous with said leading planar portion;

said blank being bent around said boundary lines orienting said planar portions relative to one another to form a substantially closed housing having said leading and trailing portions adjacent to one another, said substantially closed housing defining an internal cavity; and said extensions being bent relative to said leading portion to extend into said cavity spaced from said intermediate planar portions.

8. The microwave filter of claim 7 wherein:

one of said intermediate portions defines an aperture;

one of said extensions defines a tap portion extending therefrom; and said tap portion extends through said aperture.

9. The microwave filter of claim 7 wherein:

one of said intermediate planar portions defines an aperture; and said blank further includes a loop integrally formed therewith, said loop extending outward from said peripheral edge and contiguous with said leading planar portion, said loop being bent relative to said leading portion to extend through said aperture.

10. The microwave filter of claim 7 wherein the tip of at least one of said extensions is bent towards one of said intermediate portions to adjust the capacitance therebetween.

11. The microwave filter of claim 7 wherein one of said intermediate planar portions defines an ear bent to project into said cavity.

12. The microwave filter of claim 7 further comprising a bracket attached to one of said intermediate planar portions, said bracket defining a plurality of adjustment tabs extending into said cavity and spaced from the others of said intermediate planar portions and from said extensions.

13. A method of forming a microwave filter, comprising the steps of:

defining, with an integral blank of conductive sheet material, a peripheral edge extending around a plurality of planar portions separated by boundary lines and including a leading planar portion, a trailing planar portion and one or more intermediate planar portions;

defining, with said blank, one or more extensions extending outward from said peripheral edge and contiguous with said leading planar portion;

bending said blank around said boundary lines to orient said planar portions relative to one another to form a substantially closed housing with said leading and trailing portions adjacent to one another, said substantially closed housing defining an internal cavity; and bending said extensions relative to said leading portion to extend into said cavity spaced from said intermediate planar portions.

14. The method of claim 13 further comprising the steps of:

defining an aperture in one of said intermediate portions;

defining, with said blank, a tap portion to extend from one of said extensions; and arranging said tap portion to extend through said aperture.

15. The method of claim 13 further comprising the steps of:

defining an aperture in one of said intermediate portions;

defining, with said blank, a loop extending outward from said peripheral edge and contiguous with said leading planar portion; and arranging said loop to extend through said aperture.

* * * * *